US005969628A

United States Patent [19]

André

[11] Patent Number: 5,969,628

[45] Date of Patent: Oct. 19, 1999

[54] DISPLAY DEVICE FOR A 7-SEGMENT FONT

[75] Inventor: Jean-Marie André , Le Mans, France

[73] Assignee: U.S. Philips Corporation, New York, N.Y.

[21] Appl. No.: 09/008,334

[22] Filed: Jan. 16, 1998

[30] Foreign Application Priority Data

Jan. 21, 1997 [FR] France ..... 97 00579

[51] Int. Cl.[6] ..... G09F 9/00

[52] U.S. Cl. ..... 340/815.44; 345/34; 345/33; 345/39; 345/38

[58] Field of Search ..... 340/815.44, 815.45; 345/34, 39, 38, 30, 33, 43, 44, 46, 50, 59

[56] References Cited

U.S. PATENT DOCUMENTS

| | | | |
|---|---|---|---|
| 4,034,368 | 7/1977 | Shimomura | 340/378 |
| 4,812,835 | 3/1989 | Wada et al. | 340/756 |
| 5,644,326 | 7/1997 | Lauzon et al. | 345/34 |

*Primary Examiner*—Thomas Mullen
*Assistant Examiner*—Sihong Huang
*Attorney, Agent, or Firm*—Dicran Halajian

[57] ABSTRACT

A display device is disclosed for displaying a character having a font of the "7-segment" type. The display includes segment drivers for activating/deactivating one or various icons from a set of icons formed each by one or various electrically connected segments. The set of icons includes six icons chosen so that all the characters of the 7-segment font, including numerals zero to nine, are restorable by selective activation/deactivation of the icons.

20 Claims, 3 Drawing Sheets

DISPLAY DEVICE FOR A 7-SEGMENT FONT

DESCRIPTION

1. Field of the Invention

The present invention relates to a display device for displaying at least a character having a font of the "7-segment" type, which comprises activation/deactivation means for activating/deactivating one or various icons from a set of icons formed each by one or various electrically connected segments.

The invention also relates to a display method of displaying at least a character of a font of the "7-segment" type which consists of activating/deactivating one or various icons from a set of icons formed each by one or various electrically connected segments.

The invention finally relates to electronic equipment, notably a telephony device, comprising such a display device.

2. Background of the Invention

The invention permits of realizing such display devices at low cost, and thus has interesting applications in the field of consumer electronics.

The cost of such a display device depends, in essence, on two parameters: the surface of the screen and the number of elements (for example, segments or icons) to be controlled for the display. Indeed, the number of inputs/outputs and the size of the memory of the control device associated to such a display device are smaller as the number of elements to be controlled is lower.

A conventional "7-segment" font is shown in FIG. 1. It comprises the digits 0 to 9 formed by seven segments referenced 1 to 7 which are arranged in the form of an "8". Notably from U.S. Pat. No. 4,034,368, it is known that one seeks to reduce the number of elements to be controlled in order to diminish the cost of the display device.

In a first embodiment of the device described in U.S. Pat. No. 4,034,368, and represented in the FIG. 2, the central horizontal segment 4 is divided into an upper part 4*a* and a lower part 4*b* which are connected to the vertical upper and lower right-hand segments 3 and 7, respectively. And in a second embodiment of this device, the upper and lower horizontal segments 1 and 6 are additionally connected electrically in order to be activated and deactivated simultaneously.

This device thus permits of reducing the number of elements to be controlled to 6, or else 5 depending on the embodiment used. However, this reduction is detrimental to the quality of the displayed characters.

In the first embodiment, indeed the character "7" is displayed in a size that is smaller than that of the other characters, which is annoying for most of the applications. Moreover, in the second embodiment, the character "0" cannot be displayed.

SUMMARY OF THE INVENTION

It is an object of the invention to propose a display device which permits of reducing the number of elements to be controlled for the display and which does not have these drawbacks.

Therefore, a display device according to the invention and as described in the opening paragraph is characterized in that said set of icons comprises six icons chosen so that all the characters of said font can be restored by selective activation/deactivation of said icons.

The invention thus permits of reducing the number of elements to be controlled to 6, while ensuring the restoration of each one of the characters of the font.

While systematically exploring the solutions to this problem, the applicants have identified 213 possible sets. These 213 sets may be characterized by the fact that they all comprise one icon connecting the upper and lower right-hand vertical segments of said font.

According to a first variant of the present invention, the segments which take part in various icons are divided into as many parts as the number of icons to which they belong, and the activation/deactivation means of each of said icons control the activation/deactivation of one of these parts only.

According to a second variant, the display device according to the invention comprises protection means for protecting segments which take part in various icons, so that the activation/deactivation of one of these icons does not lead to the activation/deactivation of the other icons. This second variant permits of restoring a font of the "7-segment" type with a constant luminous intensity.

Finally, in a particularly advantageous embodiment of the present invention, one segment takes part in no more than two different icons. This embodiment provides the advantage of being simple to use and of yielding a better restoration quality in the case where the segments are divided in as many parts as the number of icons they take part in.

BRIEF DESCRIPTION OF THE DRAWINGS

These and other aspects of the invention will be apparent from and elucidated with reference to the embodiments described hereinafter.

In the drawings.

DESCRIPTION OF PREFERRED EMBODIMENT

Figure 1:
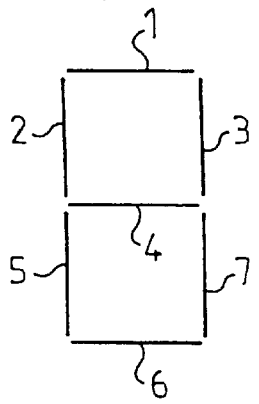
FIG. 1 PRIOR ART
FIG. 1 represents a conventional "7-segment" font.
Figure 2:
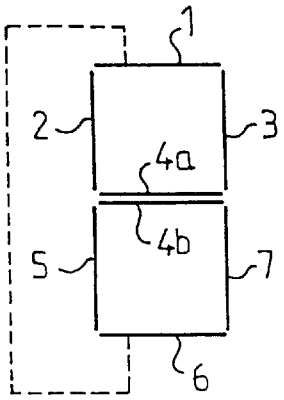
FIG. 2 PRIOR ART
FIG. 2 is an explanatory diagram of the operation of a prior-art display device.
Figure 3:
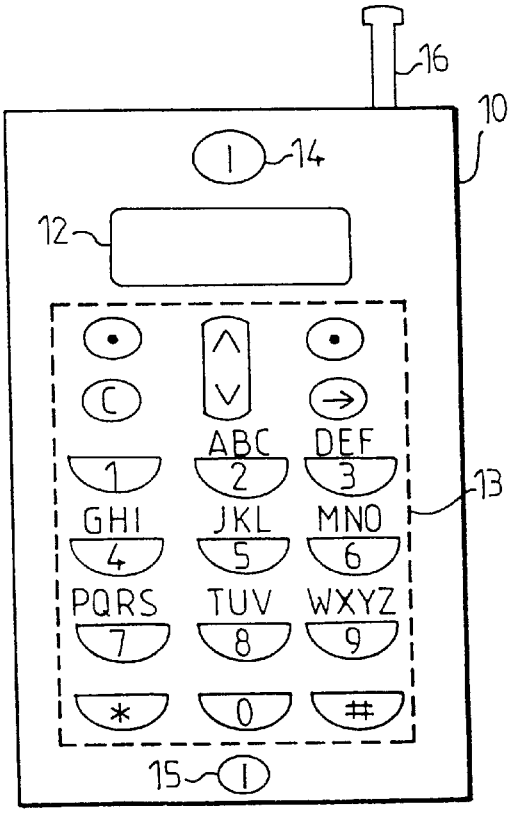
FIG. 3 represents electronic equipment according to the invention.

In FIG. 3 is diagrammatically shown a telephone 10 according to the invention. This telephone comprises a display device 12 according to the invention, a keyboard 13, an earphone 14, a microphone 15 and an antenna 16.

The display device according to the invention permits of displaying all the characters of a font of the "7-segment" type by the activation of one or various icons from a set of six icons. Each icon of this set comprises one or various electrically connected segments so that they are activated/deactivated simultaneously.

While exploring the solutions to this problem in a systematic manner, the applicants have identified 213 possible sets. In the following of the description, they will restrict themselves to giving an exposé in detail by way of example of two solutions out of these 213.

Figure 4:
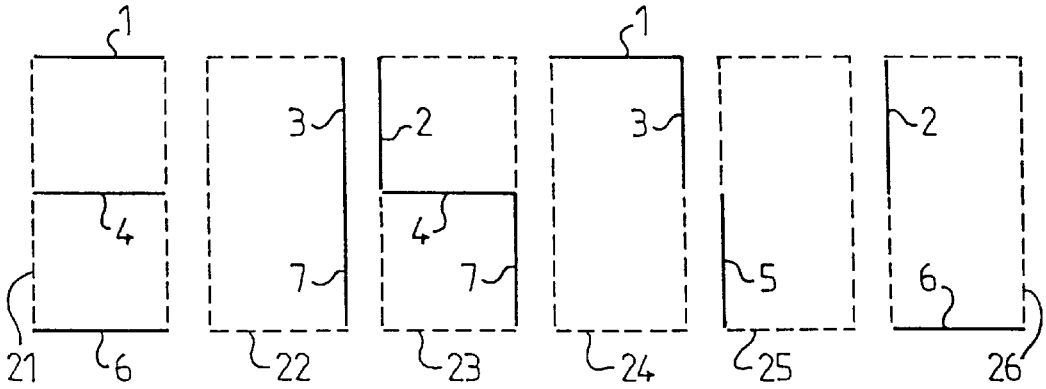
FIG. 4 represents a first example of a set of icons according to the invention.

In FIG. 4 is shown a first example of the set of six icons with which all the characters of a font of the "7-segment" type can be displayed. This set comprises six icons referenced 21 to 26. The icon 21 contains the three horizontal segments 1, 4 and 6. The icon 22 contains the two right-hand vertical segments 3 and 7. The icon 23 contains the upper left-hand vertical segment 2, the central horizontal segment 4 and the lower right-hand vertical segment 7. The icon 24 contains the upper horizontal segment 1 and the upper right-hand vertical segment 3. The icon 25 contains the lower left-hand vertical segment 5. And the icon 26 contains the upper left-hand vertical segment 2 and the lower horizontal segment 6.

Figure 5:
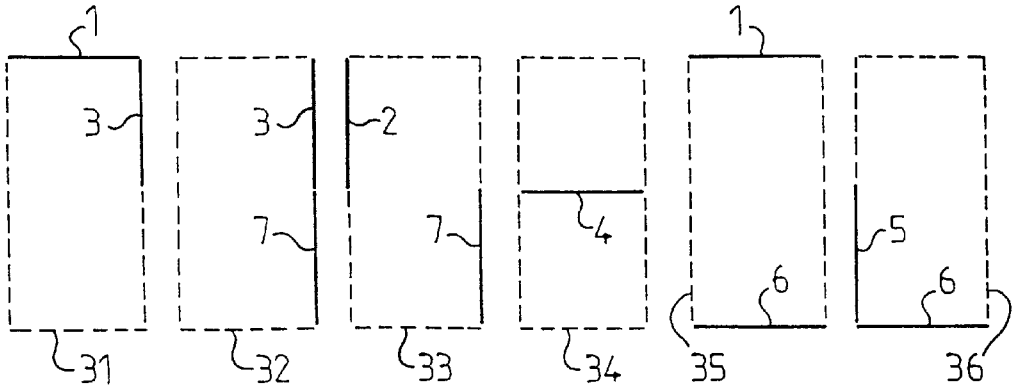
FIG. 5 presents a second example of a set of icons according to the invention.

In FIG. 5 is shown a second example of a set of six icons with which all the characters of a font of the "7-segment" type can be displayed. This set comprises six icons referenced 31 to 36. The icon 31 contains the upper horizontal segment 1 and the upper right-hand vertical segment 3. The icon 32 contains the two right-hand vertical segments 3 and 7. The icon 33 contains the upper left-hand vertical segment 2 and the lower right-hand vertical segment 7. The icon 34 contains the central horizontal segment 4. The icon 35 contains the upper and lower horizontal segments 1 and 6. And the icon 36 contains the lower left-hand vertical segment 5 and the lower horizontal segment 6.

It will be noted that the 213 sets identified by the applicants may all be characterized by the fact that they comprise an icon containing the upper and lower right-hand vertical segments 3 and 7 (icons 22 and 32 in FIGS. 4 and 5).

As this turned out to be in the examples of FIGS. 4 and 5, certain segments take part in various icons of the same set. In the following of the description, and for simplicity of the embodiments, the sets in which one segment takes part in no more than two different icons are preferred.

In a first embodiment of the invention, these segments are divided in as many parts as the number of icons which they take part in, and the activation/deactivation means of each of said icons control the activation/deactivation of one of these parts only.

Figure 6:
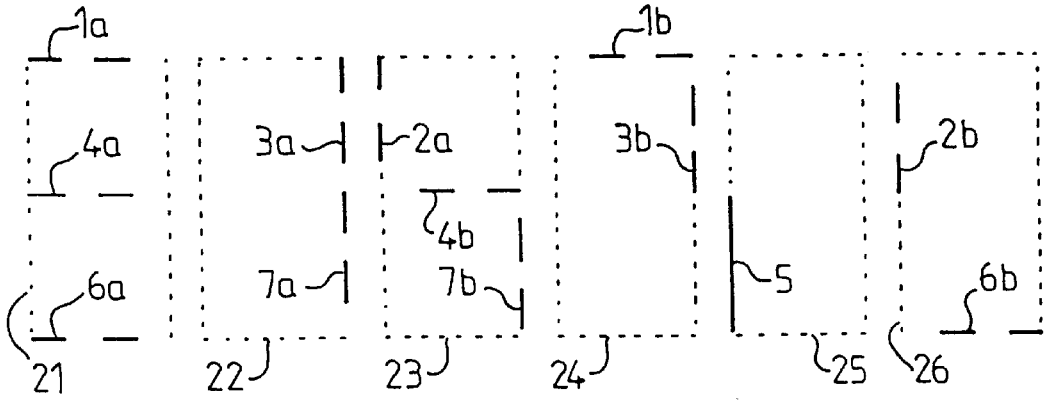
FIGS. 6 to 8 represent three variants of embodiments for the set of icons shown in FIG. 4.

In FIG. 6 is shown a first variant of this embodiment for the set of FIG. 4. The segments taking part in two icons are formed by two broken lines which are interleaved relative to each other. In FIG. 6 references of these broken lines are formed by the reference of the corresponding segment, subscripted by the letters a and b.

Figure 7:
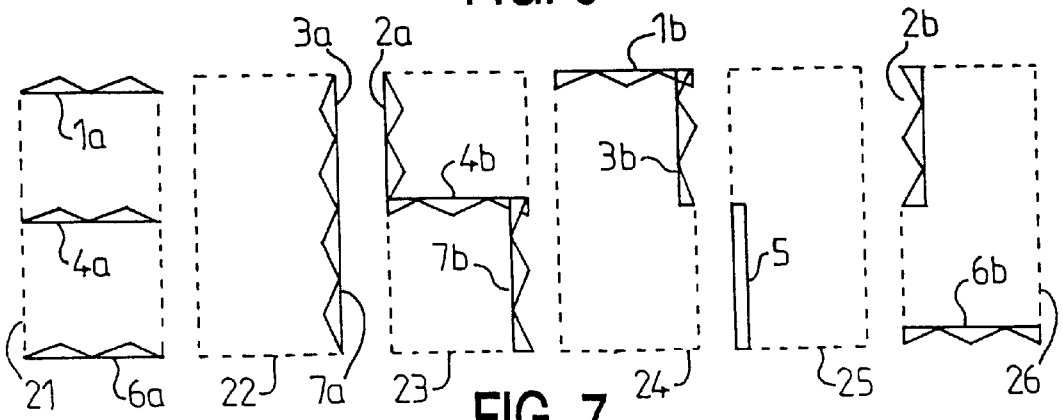

In FIG. 7 is shown a second variant of this embodiment for the set of FIG. 4. The segments which take part in two icons are formed by two jagged parts fitting into each other. In FIG. 7 the references of these jagged parts are formed by the reference of the corresponding segment subscripted by the letters a and b.

In this first embodiment, a different luminous intensity is thus obtained according to whether the two icons one segment takes part in are activated simultaneously or not. By way of example, if the digit 5 is displayed by the activation of the icons 21 and 23, the luminous intensity obtained for the central horizontal segment 4 will be twice that obtained for the other segments. It is thus possible to obtain fonts which present a great variety of aspects.

In a second embodiment, the display device according to the invention comprises protection means for protecting segments which take part in various icons, so that the activation/deactivation of one of these icons does not bring about an activation/deactivation of the other icons. By way of example, these protection means are formed by a diode connected to each control wire leading to a segment that takes part in various icons.

Figure 8:
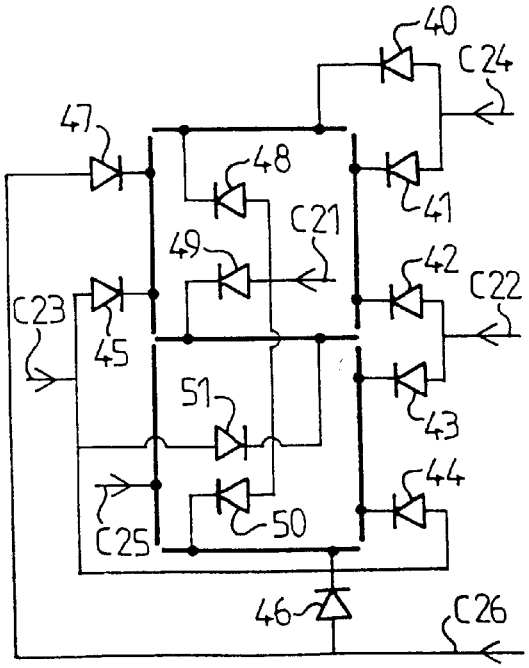

In FIG. 8 is shown an example of such an embodiment for the set of icons 21 to 26 represented in FIG. 4. The diodes are referenced 40 to 51 and the inputs through which the six icons 21 to 26 can be controlled carry the respective references C21 to C26.

This embodiment permits of obtaining a constant luminous intensity whatever the digits displayed and the segments used.

It is important to note that when a multiplexed control device is used for controlling the display device according to the invention, it is possible to reduce the number of inputs/outputs required to 5.

It will be obvious that the invention is not restricted to the embodiments that have just been described by way of example.

The principles used in the invention may notably be transposed to other types of fonts, for example, to fonts of the "14-segment" type with which it is possible to display all the alphanumerical characters.

I claim:

1. A display device for displaying at least a character having a 7-segment font comprising activation/deactivation means for activating/deactivating one or various icons from a set of icons formed each by one or various electrically connected segments, wherein said set of icons comprises six icons chosen so that all characters of said 7-segment font including numerals zero to nine are restorable by selective activation/deactivation of said icons.

2. The display device as claimed in claim 1, wherein said set of icons comprises one icon connecting the upper and lower right-hand vertical segments of said font.

3. A display device as claimed in claim 1, further comprising protection means for protecting segments which take part in various icons, so that the activation/deactivation of one of these icons does not lead to the activation/deactivation of the other icons.

4. The display device as claimed in claim 3, wherein said protection means are formed by diodes.

5. A display device as claimed in claim 1, wherein one segment takes part in no more than two different icons.

6. A display device for displaying characters having a 7-segment font comprising activation/deactivation means for activating/deactivating one or various icons from a set of icons formed each by one or various electrically connected segments, wherein said set of icons comprises six icons chosen so that all said characters of said 7-segment font can be restored by selective activation/deactivation of said icons, and wherein segments which take part in various icons are divided into as many parts as the number of icons to which they belong, and wherein the activation/deactivation means of each of said icons control the activation/deactivation of one of these parts only.

7. The display device as claimed in claim 6, wherein each of said parts is formed by a broken line, the broken lines which form a segment being interleaved relative to each other.

8. A display method of displaying a character of a "7-segment" font, which comprises an activation/deactivation of one or various icons from a set of icons formed each by one or various electrically connected segments, wherein said set of icons comprises six icons selected so as to allow generation of all characters of said font including numerals zero to nine by selective activation/deactivation of said icons.

9. Electronic equipment comprising a display device for displaying a character of a "7-segment" font, said display device comprising activation/deactivation means for activating one or various icons from a set of icons formed each by one or various electrically connected segments, wherein said set of icons comprises six icons selected so as to allow generation of all characters of said font including numerals zero to nine by selective activation/deactivation of said icons.

10. The electronic equipment of claim 9, wherein the segments which take part in various icons are divided into as many parts as the number of icons to which they belong, and wherein the activation/deactivation means of each of said icons control the activation/deactivation of only one of said parts.

11. The electronic equipment of claim 10, wherein each of said parts is formed by a broken line, the broken lines which form a segment being interleaved relative to each other.

12. The electronic equipment of claim 9, further comprising protection means for protecting segments which take part in various icons, so that the activation/deactivation of one of these icons does not lead to the activation/deactivation of the other icons.

13. The electronic equipment of claim 12, wherein said protection means are formed by diodes.

14. The electronic equipment of claim 9, wherein one segment takes part in no more than two different icons.

15. A telephone comprising a display device for displaying a character of a "7-segment" font, said display device comprising activation/deactivation means for one or various icons from a set of icons formed each by one or various electrically connected segments, wherein said set of icons comprises six icons selected so as to allow generation of all characters of said font including numerals zero to nine by selective activation/deactivation of said icons.

16. The telephone of claim 15, wherein the segments which take part in various icons are divided into as many parts as the number of icons to which they belong, and wherein the activation/deactivation means of each of said icons control the activation/deactivation of only one of said parts.

17. The telephone of claim 16, wherein each of said parts is formed by a broken line, the broken lines which form a segment being interleaved relative to each other.

18. The telephone of claim 15, further comprising protection means for protecting segments which take part in various icons, so that the activation/deactivation of one of these icons does not lead to the activation/deactivation of the other icons.

19. The telephone of claim 18, wherein said protection means are formed by diodes.

20. The telephone of claim 15, wherein one segment takes part in no more than two different icons.

* * * * *